US009111709B2

(12) United States Patent
Furuhata et al.

(10) Patent No.: US 9,111,709 B2
(45) Date of Patent: Aug. 18, 2015

(54) THERMAL OVERLOAD RELAY

(75) Inventors: Yukinari Furuhata, Konosu (JP); Fumihiro Morishita, Konosu (JP); Takeo Kamosaki, Konosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 439 days.

(21) Appl. No.: 13/389,740

(22) PCT Filed: Jul. 26, 2010

(86) PCT No.: PCT/JP2010/004739

§ 371 (c)(1),
(2), (4) Date: Mar. 12, 2012

(87) PCT Pub. No.: WO2011/048732

PCT Pub. Date: Apr. 28, 2011

(65) Prior Publication Data

US 2012/0161918 A1 Jun. 28, 2012

(30) Foreign Application Priority Data

Oct. 23, 2009 (JP) ..... 2009-244394

(51) Int. Cl.

| | |
|---|---|
| ***H01H 61/00*** | (2006.01) |
| ***H01H 83/14*** | (2006.01) |
| ***H01H 61/01*** | (2006.01) |
| *H01H 71/74* | (2006.01) |

(52) U.S. Cl.

CPC ..... *H01H 83/142* (2013.01); *H01H 61/0107* (2013.01); *H01H 71/7445* (2013.01)

(58) Field of Classification Search

CPC ..... H01H 71/7445; H01H 1/0107; H01H 83/223; H01H 83/142

USPC ..... 337/37

See application file for complete search history.

(56) References Cited

U.S. PATENT DOCUMENTS

| | | | | |
|---|---|---|---|---|
| 3,638,158 | A * | 1/1972 | Thorne | 337/49 |
| 3,792,401 | A * | 2/1974 | Anderson | 337/49 |
| 3,800,260 | A * | 3/1974 | Woodger | 337/49 |

(Continued)

FOREIGN PATENT DOCUMENTS

| | | | |
|---|---|---|---|
| DE | 10302373 | A1 | 10/2003 |
| JP | 62-274522 | A | 11/1987 |

(Continued)

OTHER PUBLICATIONS

Europe Patent Office, "Search Report for EP 10824587.9," Dec. 23, 2014.

*Primary Examiner* — Anatoly Vortman
*Assistant Examiner* — Jacob Crum
(74) *Attorney, Agent, or Firm* — Manabu Kanesaka

(57) ABSTRACT

A reset rod (43) of a thermal overload relay is configured to be switchable between a manual reset position in which a reversal mechanism (21) is manually returned to an initial state prior to reversal by performing a pushing-in operation, and an automatic reset position in which a pushed-in state is held by a pushing and rotating operation from this manual reset position, and the reversal mechanism (21) is automatically returned to the initial position. In addition, axial runout restriction portions (17*b*, 17*d*, 51, 46 and 47), which restrict axial runout of the reset rod (43) when the reset rod (43) is held in the automatic reset position, are provided.

1 Claim, 13 Drawing Sheets

(56) References Cited

U.S. PATENT DOCUMENTS

| | | | | | |
|---|---|---|---|---|---|
| 4,047,140 | A | * | 9/1977 | Anderson et al. | 337/75 |
| 4,164,724 | A | * | 8/1979 | Bogdanski | 337/86 |
| 4,270,113 | A | * | 5/1981 | Anderson | 337/75 |
| 4,321,573 | A | * | 3/1982 | Warnest et al. | 337/78 |
| 4,475,098 | A | * | 10/1984 | Hoffmann et al. | 337/49 |
| 4,528,539 | A | * | 7/1985 | Forsell et al. | 337/49 |
| 4,635,020 | A | * | 1/1987 | Sako | 337/49 |
| 4,642,598 | A | * | 2/1987 | Ichikawa et al. | 337/82 |
| 4,652,847 | A | * | 3/1987 | Sako | 337/49 |
| 4,670,728 | A | * | 6/1987 | Akiike et al. | 337/49 |
| 4,785,274 | A | * | 11/1988 | Sako et al. | 337/49 |
| 4,788,518 | A | * | 11/1988 | Sako et al. | 337/49 |
| 4,808,961 | A | * | 2/1989 | Sako et al. | 337/49 |
| 4,814,737 | A | * | 3/1989 | Ebnet | 337/49 |
| 4,845,455 | A | * | 7/1989 | Sako et al. | 337/49 |
| 4,908,594 | A | * | 3/1990 | Akiike et al. | 337/49 |
| 5,046,227 | A | * | 9/1991 | Akiike et al. | 29/896.9 |
| 5,054,754 | A | * | 10/1991 | Akiike et al. | 267/159 |
| 5,767,762 | A | * | 6/1998 | Sako | 337/348 |
| 6,459,355 | B1 | * | 10/2002 | Furuhata et al. | 337/52 |
| 6,998,553 | B2 | | 2/2006 | Hisamune et al. | |
| 7,714,692 | B2 | * | 5/2010 | Lee | 337/84 |
| 7,821,376 | B2 | * | 10/2010 | Song | 337/84 |
| 7,868,731 | B2 | * | 1/2011 | Furuhata et al. | 337/84 |
| 8,138,879 | B2 | * | 3/2012 | Furuhata et al. | 337/37 |
| 8,174,350 | B2 | * | 5/2012 | Furuhata et al. | 337/52 |
| 8,188,831 | B2 | * | 5/2012 | Morishita et al. | 337/37 |
| 2004/0085702 | A1 | * | 5/2004 | Ohkubo | 361/161 |
| 2010/0245018 | A1 | * | 9/2010 | Furuhata et al. | 337/37 |
| 2010/0245020 | A1 | * | 9/2010 | Morishita et al. | 337/72 |
| 2010/0245021 | A1 | * | 9/2010 | Furuhata et al. | 337/112 |
| 2010/0253467 | A1 | * | 10/2010 | Kamosaki et al. | 337/85 |
| 2012/0161918 | A1 | * | 6/2012 | Furuhata et al. | 337/37 |

FOREIGN PATENT DOCUMENTS

| | | | |
|---|---|---|---|
| JP | 2002-237246 | A | 8/2002 |
| JP | 4088815 | B2 | 5/2008 |

* cited by examiner

Prior Art

Prior Art

THERMAL OVERLOAD RELAY

RELATED APPLICATIONS

The present application is National Phase of International Application No. PCT/JP2010/004739 filed Jul. 26, 2010, and claims priority from Japanese Application No. 2009-244394, filed Oct. 23, 2009.

TECHNICAL FIELD

This invention relates to a thermal overload relay utilizing the characteristic curve due to temperature increase of a bimetal member, and relates to improvement of a mechanism to set a reset rod to an automatic reset position.

BACKGROUND ART

The reset mechanism of a thermal overload relay generally comprises a reset rod loaded pushably in a case, and by pushing said reset rod, a reversal mechanism performing a reversal operation accompanying the relay tripping returns to the initial state. This reset mechanism comprises a manual reset in which an operation of pushing in the reset rod is performed upon each reset, and an automatic reset in which the reversal mechanism is automatically returned to the initial state after cooling the bimetal member by holding the reset rod in the pushed-in state; the manual reset and the automatic reset being configured to be switchable.

FIG. 12 to FIG. 15 show a conventional thermal overload relay which is switchable between manual reset and automatic reset (see for example Patent Reference 1).

As shown in FIG. 12, this thermal overload relay comprises a bimetal member 2 which undergoes curving displacement due to heat generated by current conduction, and contact points 5 and 6 which cause the reversal mechanism 4 to perform a reversal operation and switch when the displacement position of the bimetal member 2 exceeds a stipulated value.

When the bimetal member 2 curves, displacement occurs in the right direction in FIG. 12, and this movement is transmitted via the shifter 8 to the release lever 9; the release lever 9 rotates in the counterclockwise direction with the shaft 10 as fulcrum. On the other hand, one end of a movable plate 14 as a fulcrum abuts against a V groove 11*a* on one end of a support piece 11 fixed to a case 1, and a tension spring 13 is hung across another end of the movable plate 14 and another end 11*b* of the support piece 11. And, a reversal plate 12 is fastened to the movable plate 14.

In the initial state of FIG. 12, the spring force from the tension spring 13 acts to rotate the reversal plate 12 in the clockwise direction, and the reversal plate 12 abuts and is halted in the state shown. In this initial state, a fixed constant point 5*b* of a normally closed contact 5 is mounted on the tip of a fixed contact point leaf spring 5*a* cantilever-supported by the case 1; this fixed contact point 5*b* contacts a movable contact point 5*c* mounted on the reversal plate 12. In addition, a fixed contact point 6*b* of a normally open contact 6 is mounted on the tip of a fixed contact point leaf spring 6*a* cantilever-supported in the proximity of the upper face of the case 1; and a movable contact point 6*d* is mounted on the tip of a movable contact point leaf spring 6*c* cantilever-supported substantially parallel to the fixed contact point leaf spring 6*a*, to oppose the fixed contact point leaf spring 6*a*.

When the bimetal member 2 curves and is displaced due to heat generated by a passing current, the release lever 9 is rotated in the counterclockwise direction, the rotation of this release lever 9 rotates the tension spring 13 and reversal plate 12 in the counterclockwise direction, and as shown in FIG. 13, the normally closed contact 5 (5*b*, 5*c*) is opened, and the normally open contact 6 (6*b*, 6*d*) is closed, to enter the tripped state. The release lever 9, reversal plate 12, tension spring 13, normally closed contact 5 and normally open contact 6 constitute the reversal mechanism 4.

When the thermal overload relay enters the tripped state and the current of the electromagnetic contactor is shut off, the bimetal member 2 cools and returns to its initial state. However, the reversal mechanism 4 which has been reversed does not return to the initial state if a reset operation is not applied. Hence a reset rod 16 is provided to protrude from the upper face of the case 1.

As shown in FIG. 15, the reset rod 16 is a cylindrical member with a step comprising a large-diameter head portion 16*a* and a small-diameter shaft portion 16*b*, and as shown in FIG. 16, the reset rod 16 is mounted in a reset rod holding hole 3 provided in the case 1 to be slidable in the shaft direction and also rotatable. The reset rod holding hole 3 comprises a large-diameter hole portion 3*a* into the interior of which the large-diameter head portion 16*a* of the reset rod 16 is pushed, and a small-diameter hole portion 3*b* formed concentrically with this large-diameter hole portion 3*a*, and which slidably holds the small-diameter shaft portion 16*b*.

In the upper face of the large-diameter head portion 16*a* is provided a groove 16*c* into which can be inserted a flat-blade screwdriver or other tool to rotate the reset rod 16. Further, on the small-diameter shaft portion 16*b* is provided an engaging piece 16*d* to protrude elastically, and in the tip at a position shifted 90° with respect to this engaging piece 16*d* is formed, by means of an inclined face and a vertical face, a cutout portion 16*e* cut out in an obtuse-angle shape. And as shown in FIG. 12, a leaf spring 6*e* integrated with the above-described fixed contact point leaf spring 6*a* abuts the cutout portion 16*e* of the reset rod 16.

The reset rod 16 loaded into the reset rod holding hole 3 is urged in the direction of protrusion from the case 1 by a return spring 7 comprising a compression spring inserted into the small-diameter shaft portion 16*b*; in FIG. 12 and FIG. 13 the reset rod 16 is in the manual reset position, and the reset rod 16 receiving the spring force of the return spring 7 is positioned in the axial direction by the engagement of the engaging piece 16*d* with a step portion 1*a* of the case 1 as shown in FIG. 12, so that the head portion protrudes from the display cover 18 occluding the upper face of the case 1. In the tripped state of FIG. 13, when an operation to push in the reset rod 16 is performed, the inclined face of the cutout portion 16*e* presses the leaf spring 6*e*, which is integral with the fixed constant point leaf spring 6*a*, from the cutout portion 16*e*. By this means the fixed contact point leaf spring 6*a* curves in the rightward direction, and presses the movable plate 14 to the right via the movable contact point leaf spring 6*c*. As a result, the reversal plate 12 in the reversed state is driven in clockwise rotation, and when the action of the tension spring 13 passes a dead point, the reversal plate 12 is reversed and returned to the initial state.

Next, in order to move from the manual reset position of FIG. 12 to the automatic reset position of FIG. 14, the tip of a flat-blade screwdriver or other tool is inserted into the groove 16*c* in the reset rod 16, and after pushing in the reset rod 16 until abutment occurs, the reset rod 16 is rotated 90° in the clockwise direction in FIG. 12. By this means, the reset rod 16 receiving the spring force of the return spring 7 from the upward axial direction is held in the pushed-in state while the engaging piece 16*d* engages the step portion 1*b* of the case 1 and is positioned in the axial direction. In this state, the tip of the leaf spring 6*e* which is integral with the fixed contact point leaf spring 6*a* is pressed out from the cutout portion 16*e* of the reset rod 16, and enters a state of riding up on the small-diameter shaft portion 16*b* of the reset rod 16. By this means, even in the initial state (non-reversed state) of FIG. 14, the gap between the fixed and movable contact points 6*b*, 6*d* of the normally open contact 6 is reduced. As a result, the passed current exceeds a stipulated value, and even when the reversal mechanism 4 begins a reversal operation, the movable contact point 6*d* does not contact the fixed contact point 6*b* and effect complete reversal before the reversal plate 12 completes reversal. Hence when the bimetal member 2 cools, the reversal mechanism 4 automatically returns to the initial state.

Patent Reference 1: Japanese Patent Publication No. 4088815

DISCLOSURE OF THE INVENTION

However, as shown in FIG. 16, a reset rod 16 in the automatic reset position has a gap between the large-diameter head portion 16*a* and the circumferential face of the large-diameter hole portion 3*a* of the reset rod holding hole 3. With a gap also provided between the small-diameter shaft portion 16*b* and the circumferential face of the small-diameter hole portion 3*b* of the reset rod holding hole 3, the entirety of the reset rod 16 tends to undergo axial runout.

If axial runout of the reset rod 16 in the automatic reset position occurs in this way, there is a change in the amount of flexing of the fixed contact point leaf spring 6*a*, contacting with the small-diameter shaft portion 16*b* of the reset rod 16 via the leaf spring 6*e*, and the gap between the fixed and movable contact points 6*b*, 6*d* of the normally open contact 6 also changes. Therefore, there is a concern that the automatic reset characteristics by which the reversal mechanism 4 automatically returns to the initial position may become unstable.

Hence this invention has been devised focusing on the above-described unresolved problem of the prior art. This invention has an object of providing a thermal overload relay in which, by restricting axial runout of the reset rod in the automatic reset position, the reversal mechanism at the time of automatic reset is made stable.

In order to attain the above object, the thermal overload relay of one embodiment includes, within a case, a bimetal member displacing curvingly by the heat generated from an overload current; a reversal mechanism performing a reversal operation and switching a contact when a displacement amount of the bimetal member exceeds a stipulated value; a columnar reset rod attached pushably into a shaft loading portion formed in the case, and one end engaging with a movable portion of the reversal mechanism when pushed in; and a return springing in which the spring force acts on the reset rod to protrude another end of the reset rod from the case, the reset rod being configured to be switchable between a manual reset position in which the reversal mechanism is manually returned to an initial state prior to reversal by performing a push-in operation, and an automatic reset position in which the pushed-in state is held by a pushing and rotating operation from this manual reset position and the reversal mechanism is automatically returned to the initial state. The thermal overload relay further includes an axial runout restriction portion restricting the axial runout of the reset rod when the reset rod is held in the automatic reset position.

By means of a thermal overload relay of this embodiment, the axial runout restriction portion restricts the axial runout of the reset rod being held in the automatic reset position, so that the position of the movable portion of the reversal mechanism engaging with one end of the reset rod is always constant, and the automatic reset characteristics by which the reversal mechanism automatically returns to the initial state can be made stable.

Further, as the axial runout restriction portion of the thermal overload relay of one embodiment, a bulging portion is formed in one of an outer periphery of the reset rod or an inner wall of the shaft loading portion, and when the reset rod is held in the automatic reset position, the bulging portion abuts another of the outer periphery of the reset rod or the inner wall of the shaft loading portion, and a pressing force is generated between the reset rod and the shaft loading portion, thereby restricting axial runout of the reset rod.

By means of the thermal overload relay of this embodiment, when the reset rod is held in the automatic reset position, because the bulging portion abuts another of the outer periphery of the reset rod or the inner wall of the shaft loading portion, a pressing force is generated between the reset rod and the shaft loading portion, and axial runout of the reset rod is restricted, so that an axial runout restriction portion with a simple configuration can be provided.

Further, in the thermal overload relay of one embodiment, the axial runout restriction portion is provided in at least two locations that are mutually separated in a length direction of the reset rod, and axial runout of the reset rod is thereby restricted.

By means of this thermal overload relay of one embodiment, by providing the axial runout restriction portion in at least two locations that are mutually separated in the length direction of the reset rod, axial runout of the reset rod can be restricted more reliably, and automatic reset characteristics can be improved.

Further, in the thermal overload relay of one embodiment, a direction in which the spring force of the return spring acts on the reset rod is a direction deviating from an axial line of the reset rod.

By means of this thermal overload relay of one embodiment, by causing the spring force of the return spring to urge from a direction deviating from the axis of the reset rod, a force to cause rotation in a prescribed direction acts on the reset rod. By means of this force to cause rotation of the reset rod, a force pressing the reset rod in the automatic reset position is generated, axial runout is further restricted, and automatic reset characteristics can be further improved.

Further, in the thermal overload relay of one embodiment, the return spring is a leaf spring member engaging at a position which does not interfere with a rotation range of the one end of the reset rod.

By means of this thermal overload relay of one embodiment, compared with a return spring comprising a coil spring disposed around the outer periphery of the reset rod is used in normal devices, disposition is easy even in a compact thermal overload relay in which there is little space for disposition of the return spring.

Further, in the thermal overload relay of one embodiment, an automatic reset engaging portion is provided on the outer periphery of the reset rod. A latching plate, which holds the reset rod in the pushed-in state by engaging with the automatic reset engaging portion when the pushed-in reset rod is rotated to the automatic reset position, is provided within the case. Abutting portions of the automatic reset engagement portion and the latching plate which mutually abut at a position where the reset rod is halted midway during rotation to the automatic reset position, are formed as inclined faces that are inclined downward toward a direction in which the reset rod is rotated to the automatic reset position, and that are in planar contact with each other.

By means of this thermal overload relay of one embodiment, when the reset rod is halted midway during rotation to the automatic reset position, the inclined face of the automatic reset engaging portion slides on the inclined face of the latching plate, so that latching of the automatic reset engaging portion and the latching plate is released, and the reset rod returns to the manual reset position. Hence the problem of halting of the reset rod at a neutral position between the manual reset position and the automatic reset position can be reliably prevented.

By means of this invention, an axial runout restriction portion restricts axial runout of the reset rod being held at the automatic reset position, so that the position of the movable portion of the reversal mechanism engaged with one end of the reset rod is always constant, and the reversal mechanism characteristics during automatic reset can be made stable.

BEST MODE FOR CARRYING OUT THE INVENTION

Figure 1:
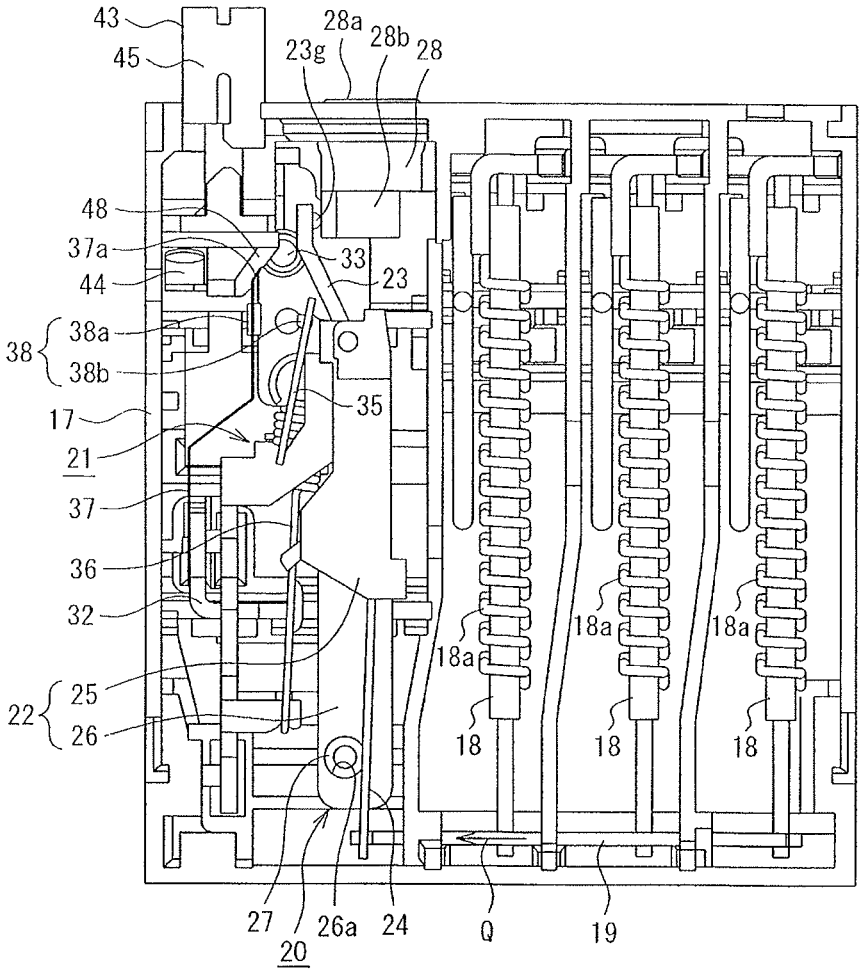
FIG. 1 is a cross-sectional view of principal portions, showing the interior of a thermal overload relay.

Below, an optimum mode for implementing the invention (hereafter called an embodiment) is explained in detail, referring to the drawings.

As shown in FIG. 1, in a thermal overload relay of this embodiment, on the upper face of an insulating case 17 are provided an adjustment portion 28*a* of an adjustment dial 28 and a reset rod 43 the head portion 45 of which protrudes; also disposed within the insulating case 17 are an adjustment mechanism 20 which is driven by displacement of a shifter 19 engaging with one end of a main bimetal member 18, and a reversal mechanism 21 contacts of which are switched by operation of the adjustment mechanism 20.

Figure 2:
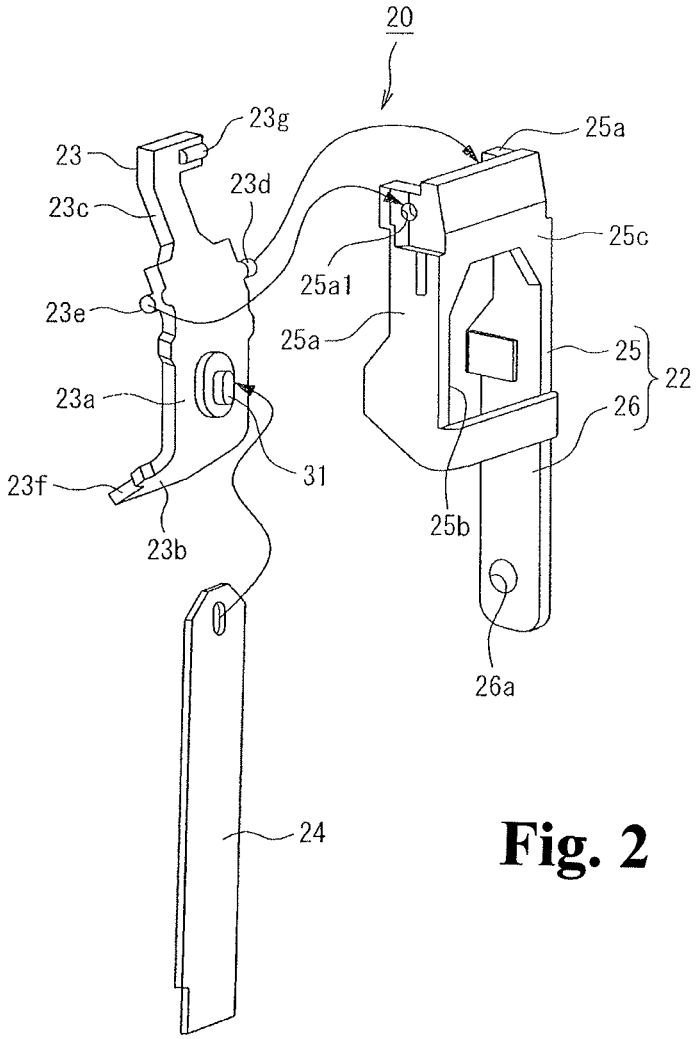
FIG. 2 is an exploded view of an adjustment mechanism of a thermal overload relay.

As shown in FIG. 2, the adjustment mechanism 20 comprises an adjustment link 22, a release lever 23 rotatably supported by the adjustment link 22, and a temperature compensation bimetal member 24 fixed to the release lever 23 and engaging with the shifter 19. The adjustment link 22 comprises a link support portion 25 which supports the release lever 23, and a leg portion 26 extending downward from one side of the link support portion 25.

The link support portion 25 comprises a pair of opposing plates 25*a* in the upper portions of which bearing holes 25*a*1 are formed, and which are mutually opposed, and a connecting plate 25*c*, connecting the pair of opposing plates 25*a*, and forming an opening portion 25*b*. The leg portion 26 extends downward from one of the pair of opposing plates 25*a*, and in the upper portion thereof is formed a bearing hole 26*a*.

And as shown in FIG. 1, on an inner wall on the lower side of the insulating case 17 is provided a support shaft 27 protruding into the insulating case 17. By inserting the tip of this support shaft 27 into the bearing hole 26*a* of the above-described leg portion 26, the entire adjustment link 22 is rotatably supported by the insulating case 17 centered on the support shaft 27.

As shown in FIG. 2, the release lever 23 of the adjustment mechanism 20 comprises a base plate 23*a*, and a pair of bent plates 23*b*, 23*c* which are bent from the two ends of the base plate 23*a* in the same direction at substantially the same angle. And, on the side of one of the bent plates 23*b* is formed a pair of rotation shafts 23*d*, 23*e*, which are inserted into the pair of bearing holes 25*a*1 of the adjustment link 22. A reversal spring pressing portion 23*f* is formed at an end of one of the bent plates 23*b* sandwiching these rotation shafts 23*d*, 23*e*. A cam contact portion 23*g* is formed on the other bent plate 23*c*. On the rear face of the base plate 23*a*, which is on the side opposite the direction of bending of the bent plates 23*b*, 23*c*, a crimp-fixing portion 31 which crimps and fixes an end of the temperature compensation bimetal member 24 is formed.

Figure 3:
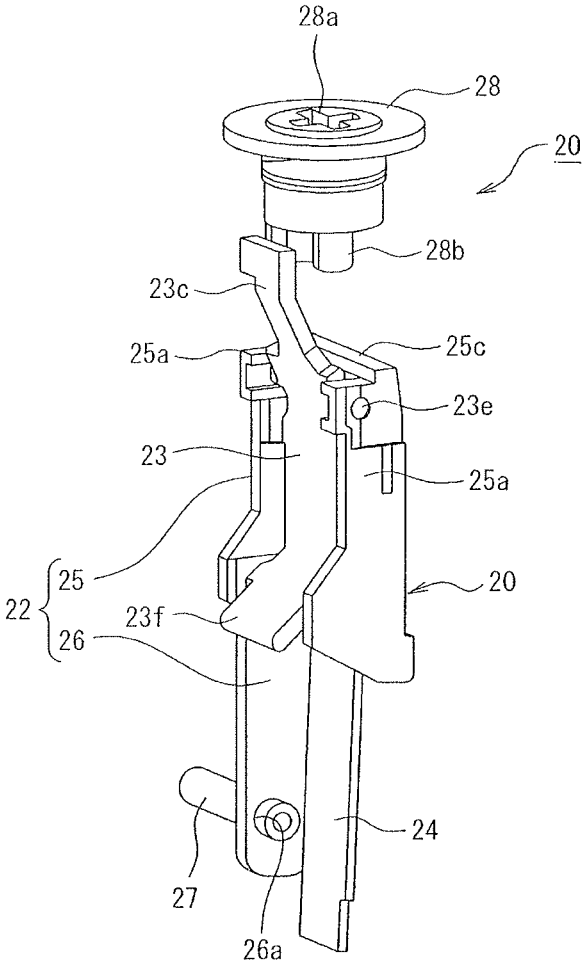
FIG. 3 shows an adjustment mechanism contacting with an adjustment dial.

And as shown in FIG. 1 and FIG. 3, an eccentric cam 28*b* of the adjustment dial 28 provided on the upper face of the insulating case 17 abuts the cam contact portion 23*g* of the release lever 23. The rotation angle of the release lever 23 is set by using the tip of a screwdriver or other tool to engage the adjustment portion 28*a* and rotate the adjustment dial 28, changing the position of the cam contact portion 23*g* abutting the peripheral face of the eccentric cam 28*b*, and causing minute rotation about the rotation shafts 23*d*, 23*e*.

Figure 4:
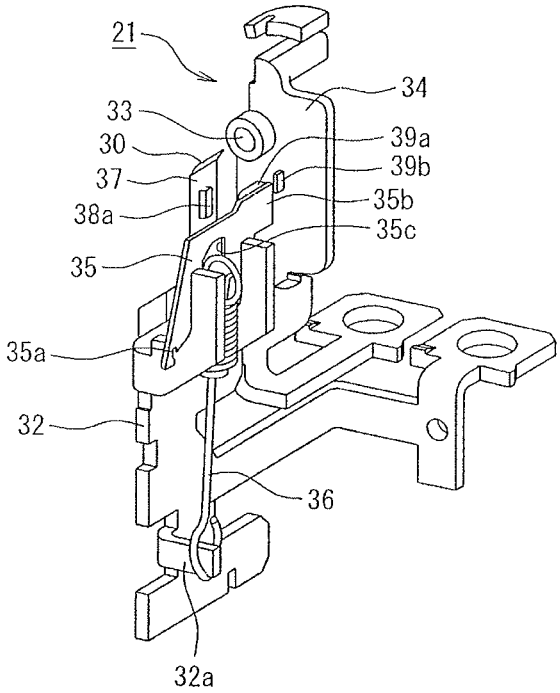
FIG. 4 shows a reversal mechanism of a thermal overload relay.
Figure 5A:
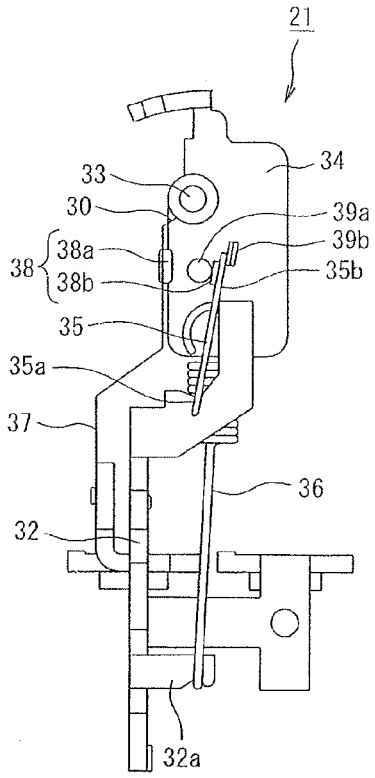
FIG. 5A shows the normally open contact (a-contact) of a reversal mechanism in the initial state.

As shown in FIG. 4 and FIG. 5A, the reversal mechanism 21 comprises a reversal mechanism support portion 32 disposed within the insulating case 17; a linking plate 34 disposed in proximity to this reversal mechanism support portion 32 and rotatably supported by a support shaft 33 provided on an inner wall of the insulating case 17; a movable plate 35 in which the upper portion 35*b* is slidably disposed with the lower portion 35*a* abutting the reversal mechanism support portion 32 as a fulcrum; and a reversal spring 36 comprising a tension coil spring stretched between an engaging hole 35*c* provided on the side of the upper portion 35*b* of the movable plate 35 and the spring support portion 32*a* of the reversal mechanism support portion 32 which is the lower position of the lower portion 35*a*.

As shown in FIG. 5A, the linking plate 34 is provided with a first engaging pin 39*a* and a second engaging pin 39*b*, enabling engagement with the movable plate 35, and causing the linking plate 34 to rotate about the support shaft 33 together with reversal operation and return operation of the movable plate 35. Further, on the reversal mechanism support portion 32 is provided in parallel a normally open contact (a-contact) side leaf spring 37, in a state with the free end extended upward; the fixed contact point 38*a* of an a-contact 38 is fixed to the free-end side of this leaf spring 37, and the movable contact point 38*b* of the a-contact 38 which contacts the fixed contact point 38*a* is fixed to the upper portion 35*b* of the movable plate 35. Here, the tip of the a-contact-side leaf spring 37 contacts the base piece 48, described below, of the reset rod 43.

Figure 6A:
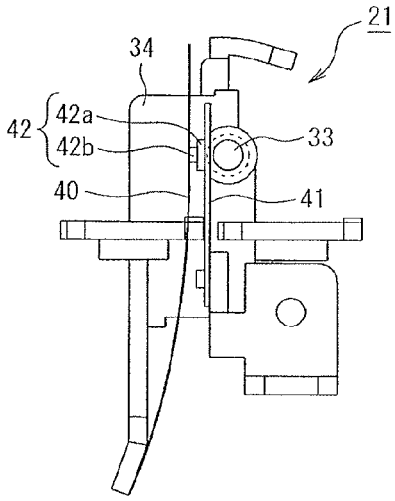
FIG. 6A shows the normally closed contact (b-contact) of a reversal mechanism in the initial state.

Further, as shown in FIG. 6A, a normally closed contact (b-contact) side leaf spring 40 is displaced at a position on the side opposite the a-contact 38 with the linking plate 34 sandwiched therebetween, in a state with the free end extended upward, and moreover a contact support plate 41 is disposed in a state opposing this leaf spring 40. The free end of the leaf spring 40 is engaged with a portion of the linking plate 34, and rotates in the same direction with rotation of the linking plate 34. The movable contact point 42*b* of the b-contact 42 is fixed to the free-end side of the leaf spring 40, and the fixed contact point 42*a* of the b-contact 42 connected to the movable contact point 42*b* is fixed to the contact point support plate 41.

Figure 7A:
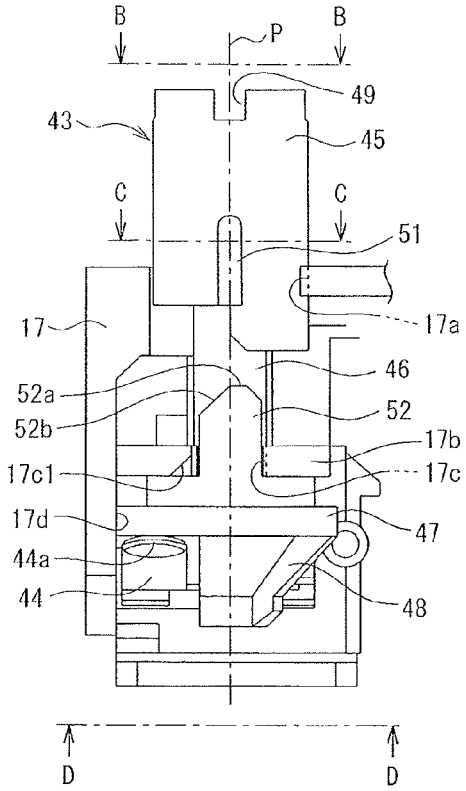
FIG. 7A shows a reset rod loaded in a shaft loading portion of a case.

As shown in FIG. 7A, the reset rod 43 is supported movably by the insulating case 17 in the axial direction and moreover rotatably about the axis, while being urged by the return spring 44 disposed on the lower side of the reset rod 43 in the direction such that the head portion 45 protrudes outside from the insulating case 17.

This reset rod 43 comprises a column-shape head portion 45; a neck portion 46, with a column shape of diameter smaller than the diameter of the head portion 45, formed coaxially with the head portion 45; a substantially disc-shape return spring engaging portion 47 formed on the end in the direction of the axis P of the neck portion 46 at a position on the side opposite the head portion 45, and engaged with the return spring 44; and a basepiece 48 formed to protrude from the return spring engaging portion 47 in the axial direction in a position on the side opposite the neck portion 46.

Figure 7B:
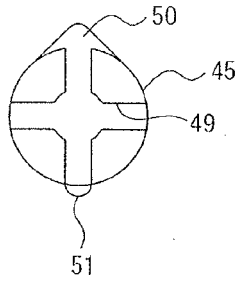
FIG. 7B is view B-B in FIG. 7A.

As shown in FIG. 7B, on the upper face of the head portion 45 is formed a groove 49 into which a flat-blade screwdriver or other tool is inserted in order to rotate the reset rod 43 substantially 90°, and in addition an indicator needle 50 which indicates the rotation position of the reset rod 43 is formed on the side peripheral face near the upper face.

Figure 7D:
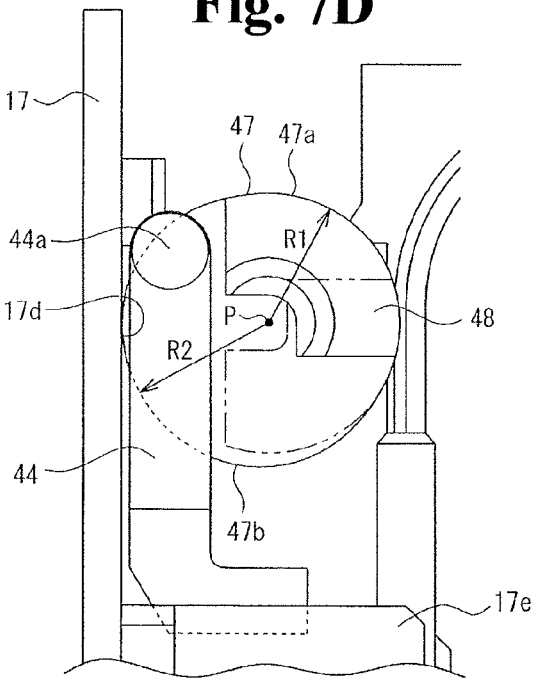
FIG. 7D is view D-D in FIG. 7A.
Figure 7C:
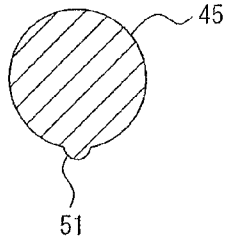
FIG. 7C is view C-C in FIG. 7A.

As shown in FIGS. 7A and 7C, a protrusion 51 is formed protruding on the outer periphery on the lower side of the head portion 45, extending in the direction of the axis P.

On the outer periphery of the return spring engaging portion 47 of the neck portion 46 is formed an automatic reset engaging portion 52 to protrude as shown in FIG. 7A, and on the face directed toward the head portion 45 of this automatic reset engaging portion 52 are formed an engaging face 52*a* intersecting the axial direction, and an inclined face 52*b* connected to this engaging face 52*a* and inclined downward in the direction toward the return spring engaging portion 47.

As shown in FIG. 7D, the return spring engaging portion 47 is a region with substantially a disc shape, having a first outer peripheral face 47*a* formed with R1 as the radius from the axis P, and a second outer peripheral face 47*b* formed with a radius R2 from the axis P larger than the radius R1 of the first outer peripheral face 47*a* (R2>R1).

And, a base piece 48 is formed in a range of substantially 90° along the first outer peripheral face 47*a* of the lower face of the return spring engaging face 47 (the face on the side opposite the neck portion 46). The outer peripheral face of this basepiece 48 is an inclined face in which the diameter is reduced gradually in the direction receding from the return spring engaging portion 47. This basepiece 48 moves about the axis P up to the position indicated by the dot-dash line by rotating the reset rod 43 substantially 90°, that is, by rotating clockwise substantially 90° in FIG. 7D.

As shown in FIGS. 7A and 7D, the return spring 44 is a leaf spring fixed in a cantilevered state to a supporting wall 17*e* provided within the insulating case 17. The spring tip 44*a* on the free end abuts the return spring engaging portion 47, and by this means the member urges the reset rod 43 with a spring force in a direction such that the head portion 45 protrudes from the insulating case 17. The direction of extension of the free end of the return spring 44 is a direction deviating from the axis P, and is a direction which does not interfere with the rotation position of the basepiece 48 (the position of the basepiece 48 indicated by the solid line and dot-dash line in FIG. 7D). Further, the spring tip 44*a* of the return spring 44 is formed in a spherical shape protruding toward the return spring engaging portion 47.

The protrusion 51 of the reset rod 43 and the automatic reset engaging portion 52 are formed on the opposite side in the circumferential direction (at a position separately by substantially 180° in the circumferential direction) of the indicator needle 50 formed on the head portion 45.

And as shown in FIG. 7A, the circumferential face of the head portion 45 of the reset rod 43 slidably abuts a first cutout hole 17*a* having a cutout portion formed in the upper portion of the insulating case 17. The circumferential face of the head portion 46 slidably abuts a second cutout hole 17*c* having a cutout portion of a latching plate 17*b* provided on the inside of the insulating case 17. The circumferential face of the return spring engaging portion 47 slidably abuts the lower portion of a side inner wall 17*d* of the insulating case 17, and the spring tip 44*a* of the return spring 44 abuts the return spring engaging portion 47 and gains a spring force. By this means the head portion 45 is disposed in the manual reset position to protrude from and enable pushing-into the insulating case 17. Further, a tip 37*a* of the a-contact-side leaf spring 37 comprised by the above-described reversal mechanism 21 contacts the inclined face (outer peripheral face) of the basepiece 48 of the reset rod 43 disposed in the manual reset position (see FIG. 1).

Here, as shown in FIG. 7A, a reset rod return inclined face 17*c*1, with a downward inclination in the direction toward the return spring engaging portion 47, is provided in the opening rim in the radial direction of the second cutout hole 17*c* formed in the latching plate 17*b* of the insulating case 17. When the reset rod 43, which is set, is halted midway during rotation to the automatic reset position, the inclined face 52*b* of the automatic reset engaging portion 52 of the reset rod 43 which has moved upward makes planar contact with the reset rod return inclined face 17*c*1.

The case of this invention corresponds to the insulating case 17. The inclined face of this invention corresponds to the reset rod return inclined face 17*c*1. The bimetal member of this invention corresponds to the main bimetal member 18. Another end of the reset rod of this invention corresponds to the neck portion 46. The bulging portion of this invention corresponds to the second outer peripheral face 47*b*. One end of the reset rod of this invention corresponds to the base piece 48. The bulging portion of this invention corresponds to the protrusion 51.

As shown in FIG. 1, when an overload current flows in a thermal overload relay configured as described above, the overload current causes the heater 18*a* to generate heat, the main bimetal member 18 wrapped around this heater 18*a* curves, and due to the displacement of the free end thereof the shifter 19 is displaced in the direction of the arrow with symbol Q in FIG. 1. Due to the displaced shifter 19, the free end of the temperature compensation bimetal member 24 is pressed, and the release lever 23 which is formed integrally with the temperature compensation bimetal member 24 is rotated in the clockwise direction about the rotation shafts 23*d*, 23*e* (see FIG. 2) supported by the adjustment link 22, and the reversal spring pressing portion 23*f* of the release lever 23 presses the reversal spring 36.

When rotation of the release lever 23 in the clockwise direction advances, and the pressing force of the reversal spring pressing portion 23*f* exceeds the spring force of the reversal spring 36, the movable plate 35 performs a reversal operation with the lower portion 35*a* as a fulcrum. Together with this reversal operation of the movable plate 35, the reversal operation of the movable plate 35 is transmitted via the first engaging pin 39*a* to the linking plate 34, which also rotates about the support shaft 33.

Figure 5B:
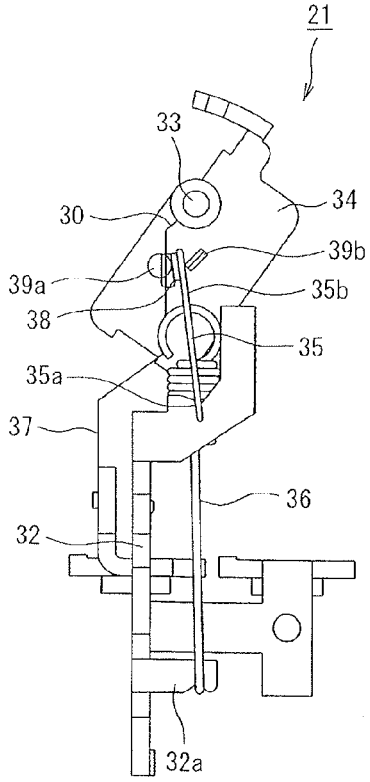
FIG. 5B shows the reversal mechanism in the tripped state.
Figure 6B:
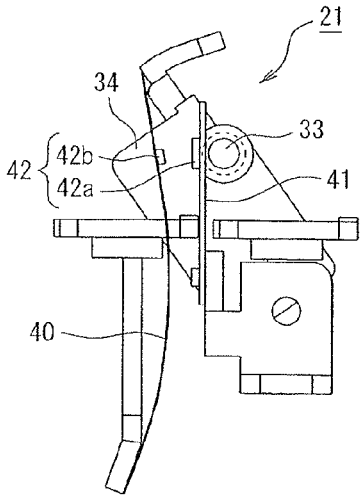
FIG. 6B shows the reversal mechanism in the tripped state.

By this means, the fixed contact point 38*a* and movable contact point 38*b* of the a-contact 38, which had been in the open state of FIG. 5A, contact (see FIG. 5B), the fixed contact point 42*a* and movable contact point 42*b* of the b-contact 42, which had been in the closed state of FIG. 6A, are separated (see FIG. 6B), so that the contacts of the reversal mechanism 21 are switched, and the thermal overload relay enters the tripped state. And, based on the information of the a-contact 38 and the b-contact 42 of the thermal overload relay, for example an electromagnetic contactor (not shown) connected to the main circuit is caused to perform a circuit-opening operation, shutting off the overload current.

When the thermal overload relay enters the tripped state and the overload current of the electromagnetic contactor is shut off, after a prescribed time has elapsed, the curving of the cooled main bimetal member 18 is corrected, and the member returns to its initial state. However, the reversal mechanism 21 in which the contacts were switched does not return to the initial state (in which the fixed contact point 38*a* and movable contact point 38*b* of the a-contact 38 are in the open state, and the fixed contact point 42*a* and movable contact point 42*b* of the b-contact 42 are in the closed state) unless a reset operation is applied.

Figure 8A:
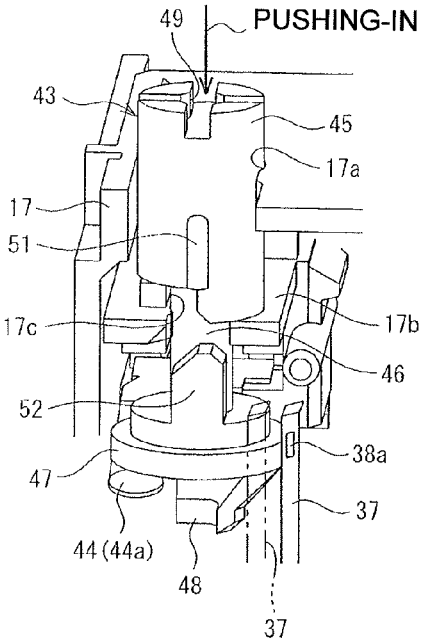
FIG. 8A is a perspective view showing a state of a reset rod pushed-in at the manual reset position.
Figure 8B:
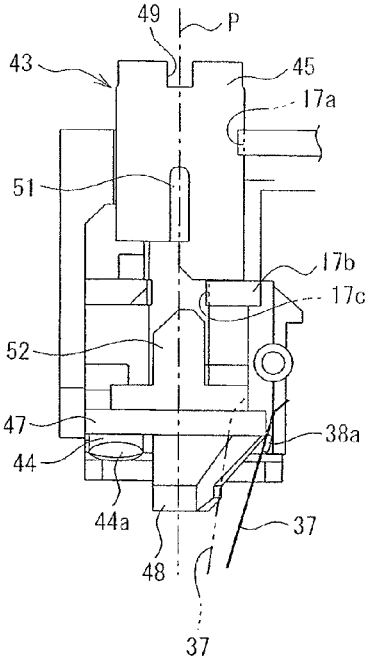
FIG. 8B shows the interior thereof.

As shown in FIGS. 8A and 8B, by performing an operation of pushing-in the reset rod 43 which is disposed in the manual reset position, manual reset is performed.

At this time, the protrusion 51 formed on the outer periphery of the head portion 45 of the reset rod 43 passes through the cutout portion of the first cutout hole 17*a*, and the automatic reset engaging portion 52 formed on the side of the return spring engaging portion 47 of the neck portion 46 passes through the cutout portion of the second cutout hole 17*c*.

By means of the operation to push-in the reset rod 43, the basepiece 48 moves downward, so that the a-contact side leaf spring 37 which contacts the inclined face of the basepiece 48 rides up onto and contacts the return spring engaging portion 47 while pressing the movable plate 35 in the reversed state. As a result, the movable plate 35 in the reversed state moves to the side of the initial position, and when the action of the reversal spring 36 exceeds the dead point, the movable plate 35 performs the return operation. By this means, the thermal overload relay returns to the initial state (with the fixed contact point 38*a* and movable contact point 38*b* of the a-contact 38 in the open state, and the fixed contact point 42*a* and movable contact point 42*b* of the b-contact 42 in the closed state).

Next, the procedure for setting the reset rod 43, in the manual reset position with the head portion 45 protruding from the insulating case 17, in the automatic reset position, and the advantageous results of this action, are explained.

Figure 9A:
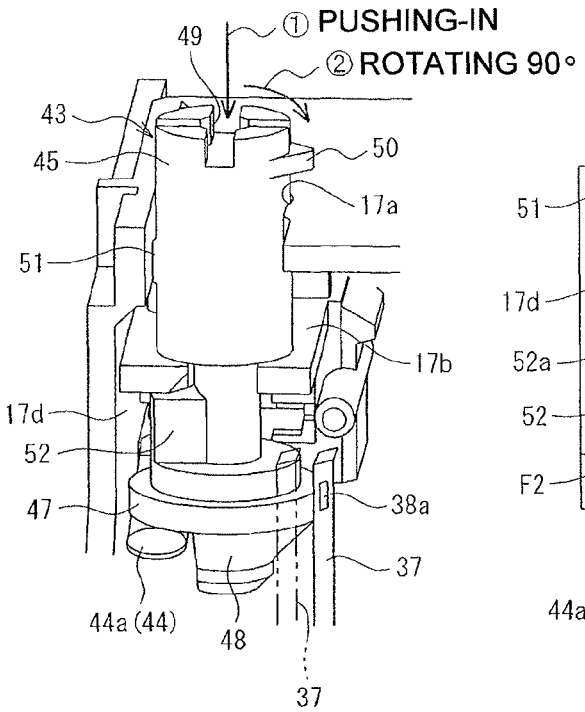
FIG. 9A is a perspective view showing a state of a reset rod set at the automatic reset position.
Figure 9B:
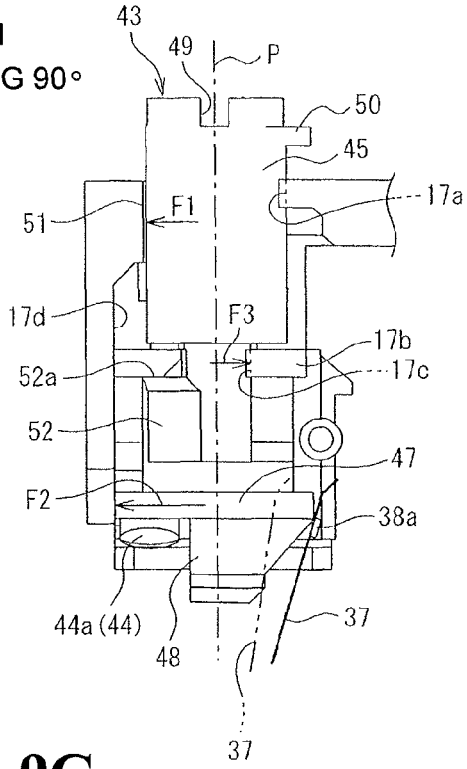
FIG. 9B shows the interior thereof.

As shown in FIGS. 9A and 9B, first the tip of a flat-blade screwdriver or other tool is inserted into the groove 49 of the reset rod 43, and after pressing-in until the head portion 45 collides with the latching plate 17*b*, the reset rod 43 is rotated 90° in the clockwise direction.

At this time, the indicator needle 50 of the pushed-in reset rod 43 is directed rightward in the figure, and the protrusion 51 and automatic reset engaging portion 52, which are positioned on the side opposite the indicator needle 50 in the circumferential direction, move to the side of the side inner wall 17*d* of the insulating case 17.

And, by means of engagement of the engaging face 52*a* of the automatic reset engaging portion 52 with the latching plate 17*b*, the pushed-in state of the reset rod 43 is held. Further, the protrusion 51 abuts the upper portion of the side inner wall 17*d* of the insulating case 17, and a pressing force F1 (see FIG. 9B) acts on the upper portion of this side inner wall 17*d*.

Further, by pushing-in the reset rod 43 and rotating 90° in the clockwise direction, the basepiece 48, while moving downward, rotates to a position which does not interfere with the return spring 44. The a-contact side leaf spring 37, which contacts the inclined face of the basepiece 48, enters a state of riding up onto the return spring engaging portion 47, and moves to a position in proximity to the movable plate 35. By this means, even when the movable plate 35 is in the initial state and not performing a reversal operation, the gap between the fixed contact point 3*a* of the a-contact 38 fixed on the a-contact side leaf spring 37 and the movable contact point 38*b* of the a-contact 38 fixed on the movable plate 35 becomes small. As a result, when the reset rod 43 is set in the automatic reset position, even when the current passed exceeds the stipulated value and the reversal mechanism 21 begins a reversal operation, the movable contact point 38*b* cannot contact the fixed contact point 38*a* and complete reversal before the movable plate 35 completes the reversal operation. Hence when the main bimetal member 18 cools, the reversal mechanism 21 automatically returns to the initial state (with the fixed contact point 38*a* and movable contact point 38*b* of the a-contact 38 in the open state, and the fixed contact point 42*a* and movable contact point 42*b* of the b-contact 42 in the closed state).

Here, when the reset rod 43 is set in the automatic reset position, the protrusion 51 of the reset rod 43 acts with a pressing force F1 on the upper portion of the side inner wall 17*d* of the insulating case 17, as shown in FIG. 9B, so that the reset rod 43 itself receives the reaction force to the pressing force F1, the return spring engaging portion 47 acts with a pressing force F2 on the lower portion of the side inner wall 17*d* of the insulating case 17, and the neck portion 46 acts with a pressing force F3 on the second cutout hole 17*c* of the latching plate 17*b*.

By this means, the reset rod 43 set in the automatic reset position acts with pressing forces F1, F2 on the same direction on both ends in the length direction, and while the center portion in the length direction acts with a pressing force F3 in the direction opposite the pressing forces F1, F2, the reset rod 43 is set in the insulating case 17, so that axial runout is restricted.

When in this way axial runout of the reset rod 43 in the automatic reset position is restricted, the position of the a-contact side leaf spring 37 engaged with the return spring engaging portion 47 is always constant, and the gap between the fixed contact point 38*a* and the movable contact point 38*b* of the a-contact 38 is also constant, so that the automatic reset characteristic for automatic return to the initial state of the reversal mechanism 21 can be made stable.

Figure 9C:
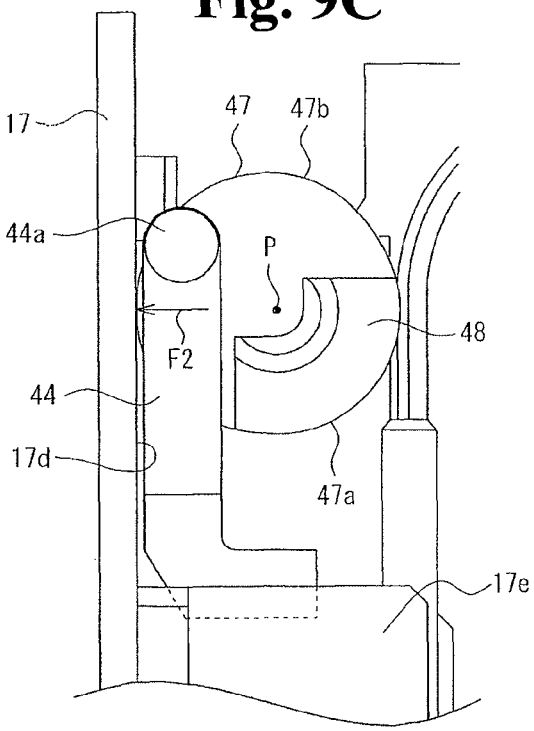
FIG. 9C shows the reset rod at the automatic reset position seen from the side of a basepiece.

Further, as shown in FIGS. 9B and 9C, the reset rod 43 in the automatic reset position is urged by the spring force of the return spring 44 from a direction deviating from the axis P, so that a force acts to rotate the reset rod 43 in a prescribed direction. By means of this rotating force, a force occurs which presses the reset rod 43 in the automatic reset position, and the axial runout of the reset rod 43 is further restricted, so that the automatic reset characteristic stability can be improved.

Further, the return spring 44 is a leaf spring which is disposed and extended to the lower-face side of the return spring engaging portion 47 to not interfere with the rotation position (see FIG. 7D) of the basepiece 48; compared with a return spring comprising a coil spring disposed on the outer periphery of the reset rod used in ordinary devices, the disposition is easy even in a compact thermal overload relay in which there is little space for disposition of a return spring 44.

Further, a spherical shape is formed on the tip 44*a* of the return spring 44, and the contact area of the tip 44*a* contacting with the lower face of the return spring engaging portion 47 is set to be small, in a structure in which sliding friction between the return spring engaging portion 47 and the contact portion of the return spring 44 is reduced, so that operation of the reset rod 43 is not impeded.

A case is explained in which an operation of setting the reset rod 43 from the manual reset position to the automatic reset position is halted midway.

Figure 10:
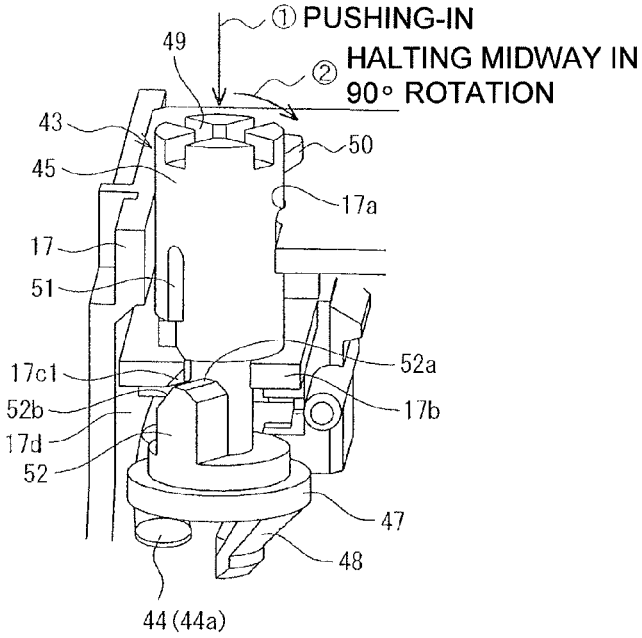
FIG. 10 is a perspective view showing a reset rod midway through rotation to the automatic reset position.

For example, suppose that as shown in FIG. 10, after pushing-in the head portion 45 until it collides with the latching plate 17*b*, rotation of the reset rod 43 is halted midway during rotation 90° in the clockwise direction (for example, at approximately 45').

Figure 11:
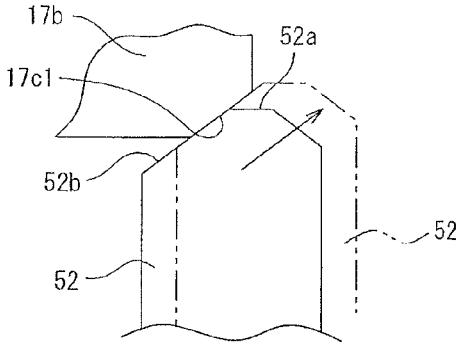
FIG. 11 is a summary view showing principal portions of FIG. 10.
Figure 12:
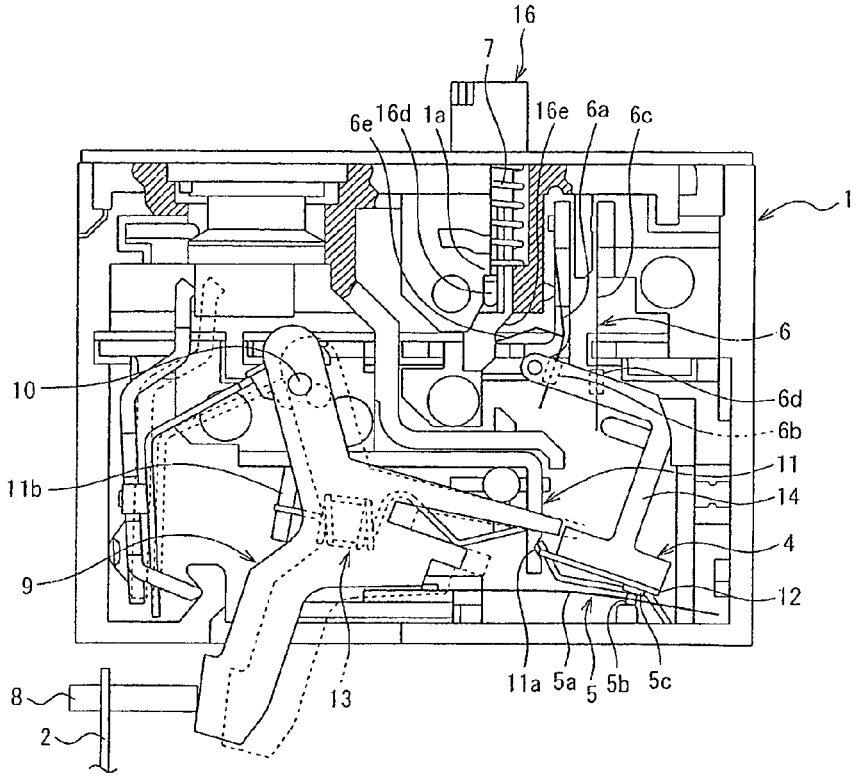
Prior Art Fig. 12
FIG. 12 shows the interior of a conventional thermal overload relay in the initial state.
Figure 13:
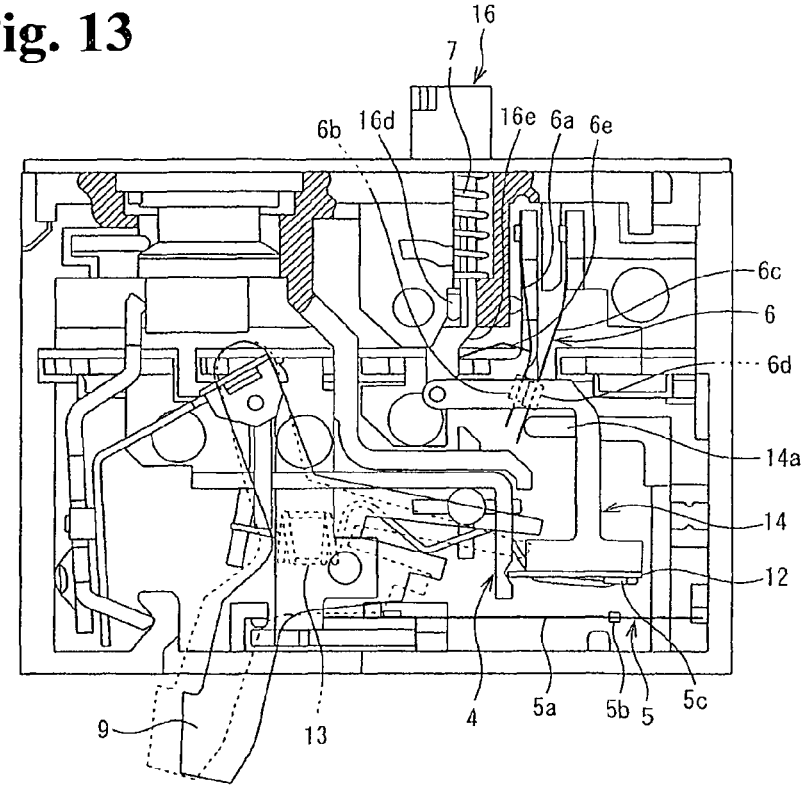
FIG. 13 shows the interior of a conventional thermal overload relay in the tripped state.
Figure 14:
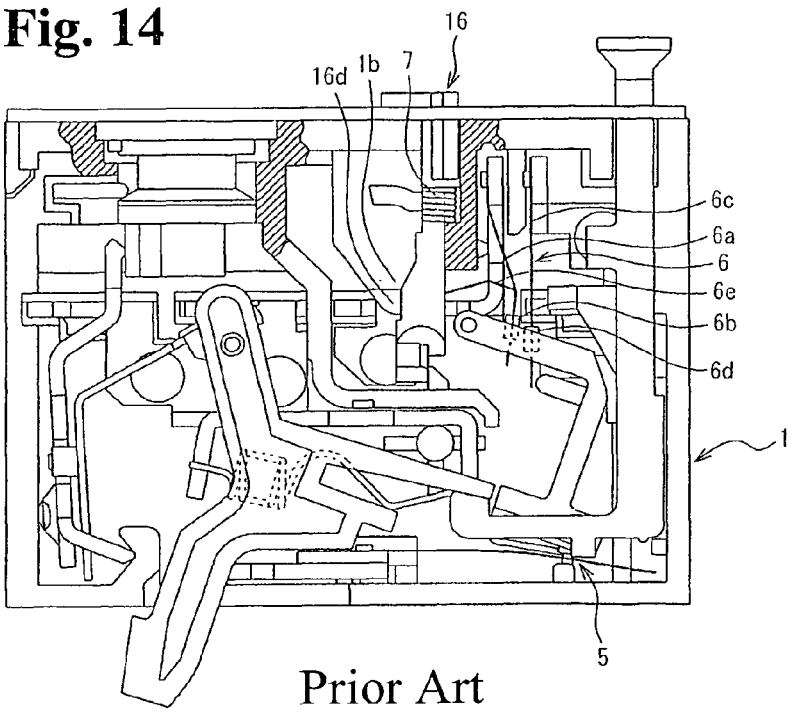
FIG. 14 shows a state in which the reset rod is held at the automatic reset position in a conventional thermal overload relay.
Figure 15:
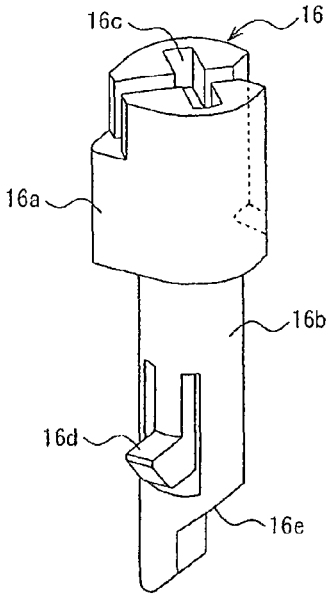
Prior Art Fig. 15
FIG. 15 shows the structure of the reset rod of a conventional thermal overload relay.
Figure 16:
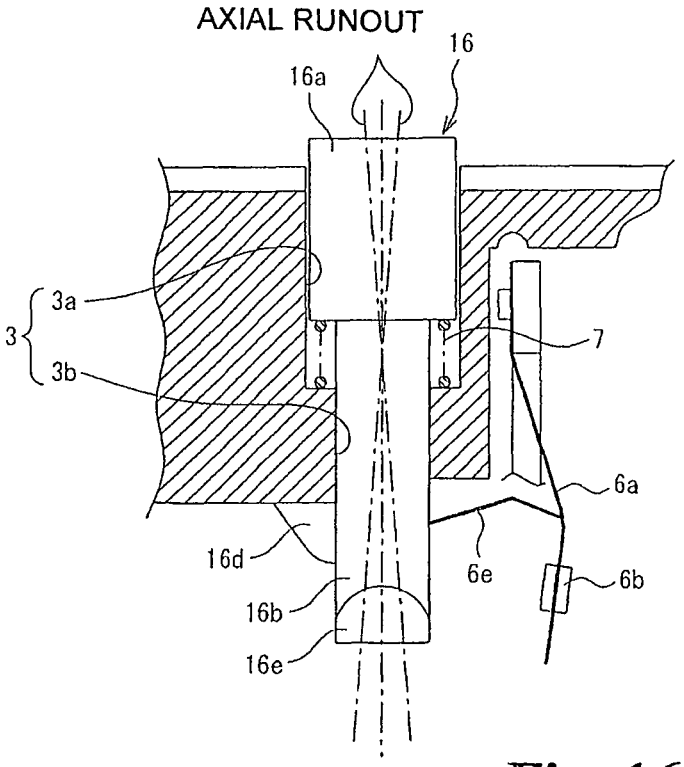
Fig. 16 Prior Art
FIG. 16 is a summary view showing a state in which axial runout of the reset rod occurs in the automatic reset position in a conventional thermal overload relay.

Upon releasing the pushed-in state of the reset rod 43, the reset rod 43 moves upward (in the direction in which the head portion 45 protrudes from the insulating case 17) due to the spring force of the return spring 44 as shown in FIG. 11, and the inclined face 52*b* of the automatic reset engaging portion 52 makes planar contact with the reset rod return inclined face 17*c*1. The automatic reset engaging portion 52, to which an upward force is applied, moves upward while rotating in the counterclockwise direction, while the inclined face 52*b* slides over the reset rod return inclined face 17*c*1 (the direction of the arrow in FIG. 1).

And, the automatic reset engaging portion 52 passes through the cutout portion of the second cutout hole 17*c*, and is positioned above the latching plate 17*b*. By this means, the head portion 45 of the reset rod 43 returns to the manual reset position protruding from the insulating case 17.

In this way, when an operation to set the reset rod 43 in the automatic reset position is halted midway, the inclined face 52*b* slides over the reset rod return inclined face 17*c*1 of the latching plate 17*b* By this means, the engagement of the automatic reset engaging portion 52 and the latching plate 17*b* is released, and the reset rod 43 returns to the manual reset position, so that the problem in which the reset rod 43 halts at a neutral position between the manual reset position and the automatic reset position can be reliably prevented.

INDUSTRIAL APPLICABILITY

As explained above, in a thermal overload relay of this invention, axial runout of the reset rod in the automatic reset position is restricted, so that the characteristics of the reversal mechanism during automatic reset can be made stable.

EXPLANATION OF REFERENCE NUMERALS

17 Insulating case
17*a* First cutout hole
17*b* Latching plate
17*c* Second cutout hole
17*c*1 Reset rod return inclined face
17*d* side inner wall
17*e* Support wall
18 Main bimetal member
18*a* Heater
19 Shifter
20 Adjustment mechanism
21 Reversal mechanism
22 Adjustment link
23 Release lever
23*a* Base plate
23*b*, 23*c* Bent plate
23*d*, 23*e* Rotation shaft
23*f* Reversal spring pressing portion
23*g* Cam contact portion
24 Temperature compensation bimetal member
25 Link support portion
25*a* Opposing plate
25*a*1 Bearing hole
25*b* Opening portion
25*c* Connecting plate
26 Leg portion
26*a* Bearing hole
27 Support shaft
28 Adjustment dial
28*a* Adjustment portion
28*b* Eccentric cam
31 Crimp-fixing portion
32 Reversal mechanism support portion
32*a* Spring support portion
33 Support shaft
34 Linking plate
35 Movable plate
35*a* Movable plate lower portion
35*b* Movable plate upper portion
35*c* Engaging hole
36 Reversal spring
37 a-contact side leaf spring
37*a* a-contact side leaf spring tip
38 a-contact
38*a* Fixed contact point
38*b* Movable contact point
39*a* Engaging pin
39*b* Engaging pin
40 b-contact side leaf spring
41 Contact support plate
42 b-contact
42*a* Fixed contact point
42*b* Movable contact point
43 Reset rod
44 Return spring

44*a* Spring tip
45 Head portion
46 Neck portion
47 Return spring engaging portion
47*a* First outer peripheral face
47*b* Second outer peripheral face
48 Basepiece
49 Groove
50 Indicator needle
51 Protrusion
52 Automatic reset engaging portion
52*a* Engaging face
52*b* Inclined face
P Reset rod axis

What is claimed is:

1. A thermal overload relay, comprising:

a bimetal member displacing curvingly from a heat generated by an overload current;

a reversal mechanism switching a contact by performing a reversal operation when a displacement amount of the bimetal member exceeds a stipulated value;

a columnar reset rod attached pushably into a shaft loading portion formed in a case, one end of the reset rod engaging with a movable portion of the reversal mechanism when pushed in; and a return spring in which a spring force acts on the reset rod to protrude another end of the reset rod from the case, said bimetal member, reversal mechanism, reset rod and return spring being disposed in the case, wherein said reset rod is switchable between a manual reset position manually returning the reversal mechanism to an initial state prior to reversal by performing a push-in operation, and an automatic reset position automatically returning the reversal mechanism to the initial state by holding a pushed-in state occurring by a pushing and rotating operation from the manual reset position;

wherein an axial runout restriction portion is provided to restrict axial runout of the reset rod when the reset rod is held in the automatic reset position, wherein an automatic reset engaging portion is provided on an outer periphery of the reset rod, a latching plate is provided in the case, the latching plate holding the reset rod in the pushed-in state by engaging the automatic reset engaging portion when the pushed-in reset rod rotates to the automatic reset position, and abutting portions of the automatic reset engagement portion and the latching plate mutually abutting at a position where the reset rod is halted midway during rotation to the automatic reset position, extending with a declining angle toward a direction in which the reset rod is rotated to the automatic reset position, and formed as an angled surface to planar contact each other.

* * * * *

UNITED STATES PATENT AND TRADEMARK OFFICE

CERTIFICATE OF CORRECTION

PATENT NO. : 9,111,709 B2
APPLICATION NO. : 13/389740
DATED : August 18, 2015
INVENTOR(S) : Yukinari Furuhata et al.

It is certified that error appears in the above-identified patent and that said Letters Patent is hereby corrected as shown below:

Specification

Please change column 10, line 39, from "... contact point 3a ..." to --... contact point 38a ...--.

Please change column 11, line 44, from "approximately 45')." to --approximately 45°).--.

Signed and Sealed this
Ninth Day of February, 2016

Michelle K. Lee

Michelle K. Lee
*Director of the United States Patent and Trademark Office*